United States Patent [19]

Luotonen et al.

[11] 4,281,497

[45] Aug. 4, 1981

[54] COMPOUND BEAM

[75] Inventors: Pekka Luotonen; Yrjö Tolonen, both of Espoo, Finland

[73] Assignee: Valtion Teknillinen Tutkimuskeskus, Finland

[21] Appl. No.: 41,736

[22] Filed: May 23, 1979

[30] Foreign Application Priority Data

| | | | |
|---|---|---|---|
| Jun. 5, 1978 | [FI] | Finland | 781775 |
| Jan. 10, 1979 | [FI] | Finland | 790065 |
| Feb. 7, 1979 | [FI] | Finland | 790396 |

[51] Int. Cl.[3] ..... E04C 3/30

[52] U.S. Cl. ..... 52/730; 52/601; 52/823; 52/727

[58] Field of Search ..... 52/727, 729, 730, 732, 52/823, 824, 825, 601, DIG. 6; 85/11

[56] References Cited

U.S. PATENT DOCUMENTS

| | | | |
|---|---|---|---|
| 1,420,528 | 6/1922 | Day | 85/11 |
| 1,752,671 | 4/1930 | Knight | 52/601 |
| 3,102,617 | 9/1963 | Helfman | 52/727 |
| 3,181,412 | 5/1965 | Hill | 85/11 |
| 3,281,168 | 10/1966 | Dufficy | 85/11 |
| 3,310,324 | 3/1967 | Boden | 85/11 |
| 3,385,015 | 5/1968 | Hadley | 52/223 |
| 3,468,090 | 9/1969 | L'Hermite | 52/309.17 |
| 3,531,901 | 10/1970 | Will | 52/823 |

FOREIGN PATENT DOCUMENTS

| | | | |
|---|---|---|---|
| 2241135 | 3/1974 | Fed. Rep. of Germany | 52/730 |
| 1158661 | 6/1958 | France | 52/825 |
| 1171513 | 1/1959 | France | 52/601 |
| 321421 | 5/1957 | Switzerland | 52/823 |
| 558875 | 1/1944 | United Kingdom | 52/DIG. 6 |

*Primary Examiner*—Price C. Faw, Jr.
*Assistant Examiner*—Henry E. Raduazo
*Attorney, Agent, or Firm*—McGlew and Tuttle

[57] ABSTRACT

A compound beam, column or rod, consisting of a web (31) of timber or a wood-based board material or plastic material and of one or several flanges formed of sheet metal and affixed to the margin and bent around the web. The flange (32) has been affixed to the web by teeth or equivalent extending substantially through the web, and possibly using glue as aid. The teeth (33,34) bend when striking against the opposite flange metal sheet, producing a permanent joint. The teeth may also be affixed to the opposite flange by welding. A stress may be produced in the flange before it is joined to the web.

6 Claims, 9 Drawing Figures

COMPOUND BEAM

FIELD AND BACKGROUND OF THE INVENTION

The present invention relates, in general, to the construction of beams and more particularly, to a compound beam comprising a web plate consisting of a non-metalic material such as timber or of wood-based board and a flange affixed to at least one end thereof. This structure is particularly suited for use as a beam, rod or column, which will be subjected to, bending, tension or compressive stress or a combination thereof.

Various kinds of beams, columns or rods of timber construction utilizing a plate as their web component are commonly employed in the primary and secondary structures of buildings. Compound beams assembled from separate parts are in themselves known in prior art. They typically consist of a web plate and of timber flanges attached thereto by glue, nails or screws. The attachment of the flange to the web plate is accomplished by glueing alone or in combination with nails or screws, and the pressing which the glue requires during its curing period is accomplished in a press or by means of nails or screws.

In the German application prints No. 2 021 028 and 2 042 800, examples are disclosed of compound beam designs known in the art. The first of these publications discloses a timber beam, the deflection of which the deflection has been reduced by providing a metal strip on the side that will be subjected to tensile stress. This strip serves to take up the greater part of the tensile stress. It is also possible with the aid of this strip, to establish in the beam an existing stress, this being done by curving the timber beam before attaching the strip.

In the latter application print, a combination beam is disclosed in which the web consists of sheet metal and the flanges are timber strips attached thereto by nailing, for instance.

Numerous drawbacks are associated with the flanged beams of the prior art. In the case of beams composed of timber material alone, the major drawback in practice is connected with the deflections, among which in particular the vibration of the structural part due to moving loads is experienced as a factor seriously interfering with the comfort of living. in the case of long spans and prolonged loading, the relatively low rigidity and major creep of the timber give rise to objectionable deflections, which as a rule are clearly visible. Undesirable deformations, moreover are caused under variable humidity conditions by the sensitivity of timber to moisture, especially in box-type structures.

The massive character of the solid timber structures employed imposes extra load on other structural parts and implies uneconomic use of timber. Timber material is likewise wasted by present-day frame structure designs in load-bearing and non-bearing structures, especially in thick walls, and these designs are characterized by poor thermal economy. The use of a metallic web in a compound beam is also not recommended because a so-called cold bridge is established between different structural components.

Drawbacks are also encountered in the manufacturing of glued asemblies. Closely controlled plant conditions are required ro regulate humidity and temperature. In addition, close supervision of the process and pressing throughout the glue curing period is required.

The manufacturing process, moreover, is labor-intensive.

Nailed joints can be made in plant facilitates or on site. But the drawback of this type of construction is that the number of nails required to insure a given strength tends to become unreasonably high, and thus compels the designer to increase the areas of components merely to provide space for placement of the nails. Nailing at too close a spacing causes checking of the timber. Furthermore, nailed joints are subject to creep under permanent load and give rise to deflections in the course of time. Nail plates are generally used when it is desired to mutually connect timber parts of a structure. The normal stresses are taken onto the wood, and the nail plate only operates as connector and transmitter of stresses. Attempts to place a stress on beams assembled with timber have not been successful to date.

SUMMARY OF THE INVENTION

The objective of the present invention is to elimination of the mentioned drawbacks, and the provision of a new structural part having better characteristics.

In accordance with a feature of the invention, a compound beam structure includes an elongated web member having oppositely disposed side surfaces and an end surface, a substantially U-shaped flange member having leg portions abutting against a part of the oppositely disposed side surfaces of the web member and an end portion, connecting the leg portions, abutting against the end surface of the web member. Each of the letg portions has a tooth portion formed as an integral part thereof extending transversely of the leg portion and penetrating through a substantial portion of the thickness of the web member to fixedly attach the flange member to the web member.

The following advantages, among others are, afforded by the present invention.

The inventive compound beam structure has considerably higher rigidity, compared with an all-timber structure. This high rigidity is due to both the high modulus of elasticity of the metal flange and to the nearly slip-free joint between the flange and in wooden web plate.

The manufacturing is fast, simple and of process character.

Flanges having various configuration can be used. They may have asymmetrical shape and even very large cross section.

It is possible, with the aid of the flange shaping, to regulate the lateral rigidity of the structure.

Through the simple shape of the structure, a tight installation of thermal insulations is made possible, whereby the structure will be advantageous with respect to heat economy due to the absence or reduction of piercing, massive and thermally conductive frame parts.

It is easy, and frequently favourable economically in view of thermal insulation as well as materials consumption, to increase the height dimension of the structure.

Cladding sheets or any other structures connecting with the flanges are easily and durably affixed in numerous ways.

The structure has low weight and small volume, thereby resulting in low transport costs.

It is possible to stress the structure.

The components can be produced in continuous strip form with any requisite lengths cut therefrom.

Suitable materials for the web plate of the structure are: cut timber, glued timber and nearly all kinds of wood-based boards, and plastic.

No special requirements are imposed on the manufacturing conditions.

In the joint between flange and web, accomplished with the aid of the tooth portions, the full thickness dimension of the web can be utilized, thus avoiding potential failure by shearing in the surface layer of the web.

The various features of novelty which characterize the invention are pointed out with particularlity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
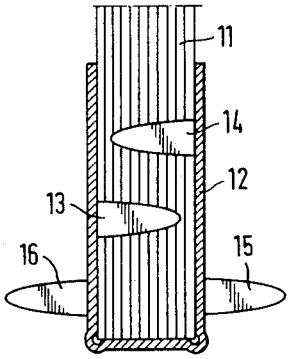
FIG. 1 is a sectional illustration of a compound beam structure constructed in accordance with an embodiment of the invention.

Referring now to the figures, FIG. 1 illustrates a compound beam structure 10 which includes an elongated web plate 11 having oppositely disposed side surfaces 17, 18 and an end edge surface 19. The web plate 11 is made from a non-metallic material, for example, a wood-based board material such as plywood or a plastic. A substantially U-shaped flange member 12 having oppositely disposed leg portions 12*a*, 12*b* abutting against part of the oppositely disposed side surfaces 17, 18, respectively, and an end portion 12*c*, connecting the leg portions, abutting against the end edge surface 19 jackets a part of the web plate 11. The flange member 12 may be from a sheet metal, for example, steel. In the sides or leg portions of the sheet metal flange, tooth portions 13,14 have been integrally formed, for example, by punching. The tooth portions may have greater width either in the longitudinal or transversel direction of the flange. Similarly, other flange tooth portions 15,16 may be formed, which are required for components meant to be affixed to the flange.

At the stage when the compound structure is being made, the sheet metal flange i bent around the web plate, whereupon the tooth portions 13,14 penetrate into the web plate 11, thus fixedly securing the flange member 12 to the web plate 11. The tip of one tooth portion 13 is separated from the root of another, opposing tooth portion 14.

Figure 2:
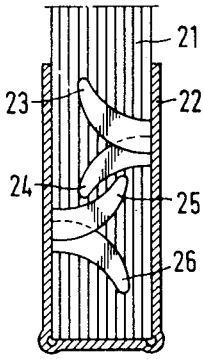
FIG. 2 shows a section through another embodiment of the invention.

FIG. 2 illustrates another favourable embodiment of a compound beam structure 20 according to the invention. In this embodiment, a web plate 21 may consist of a non-metallic material as used in the example of FIG. 1. A flange sheet 22, too, is equivalent ot the flange sheet in FIG. 1, except that integral tooth portions 23–26 punched out of this sheet have been given an arcuate shape so that they automatically orient the leg portions when joined to side surfaces of the web plate 21. Such a self-directing feature considerably increases the strength of the joint. This is simply accomplished by arcing the teeth in that direction in which they are desired to seek their way. This self-directing feature may also be achieved by means of the configuration of the teeth.

Figure 3:
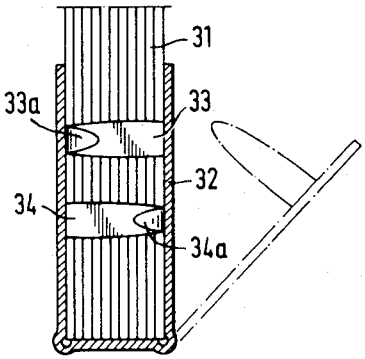
FIG. 3 shows a section through still another embodiment of the invention.

In FIG. 3 a compound beam structure 30 according to an embodiment of the invention is depicted which affords optimum strength, against transversel loads. Integral tooth portions 33 and 34 have been formed by punching the flange 32 formed about a web plate 31 consisting of plywood or of an equivalent material. The tooth portions 33 and 34, however, are dimensioned greater than the thickness of the web plate 31 such that at the final stage of the mutual attachment of flange and web plate the tip of each tooth portion 33 and 34 will hit against the metal sheet on the opposite side causing their so-called clinching. In other words, the tip 33*a* or 34*a*, respectively, bends to preferably semicircular shape, creating an extremely firm locking. In this example, too, the securing of the web may be further enhanced in that, as the tooth portion 33,34 meets the opposite flange sheet, an electric current is connected between them, whereby the tooth will become welded fast in a joint resembling a spot weld. The local heating accompanying the welding process is not dangerous because the metallic leg portion prevents the access of oxygen and thereby also the ignition of the web plate.

Figure 4A:
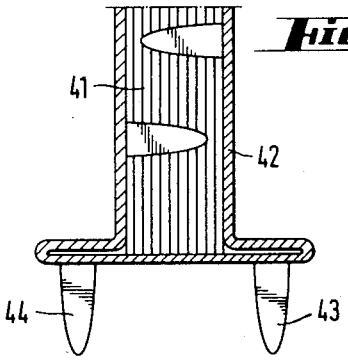
FIGS. 4*a* and 4*b* are sections of still other advantageous embodiments of the invention.

Another embodiment of a compound beam structure 40 according to the invention has been shown in FIG. 4*a*. An important additional advantage is gained with its aid. In this example, too, a web plate 41 has been encircled with a flange member 42. The fixing of the substantially U-shaped flange 42 to the web plate 41 may be accomplished by any one of the tooth shapes present in FIGS. 1 through 3. However, a substantial advantage is gained in this example by means of projections 45,46 extending the base of the flange member which include tooth portions 43,44 to which it is possible to attach integrally or by suspending, a cladding sheetor any other structural element—by welding, using screws, or in any other way.

Figure 4B:
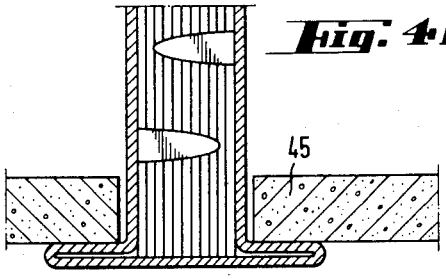

FIG. 4*b* illustrates a similar compound beam structure 40' having a web plate 41' and a flange member 42'. A cladding sheet, lagging material and/or other structure 45 may also be placed, without fixing, upon projections 45', 46' or it may be affixed in this position e.g. by self-tapping screws passing through the projections.

Figure 5:
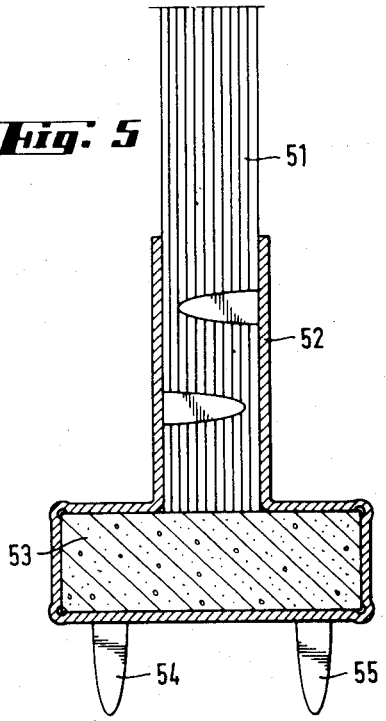
FIG. 5 is a section through another embodiment of the invention.

In FIG. 5 a compound beam structure 50 according to an advantageous embodiment example of the invention has been presented. In this example, the edge of a web plate 51 has been encircled with a flange member 52. However, the flange member has been shaped so as to have an open, rectangular cross section affording ample space. Configurations other than a rectangle may also be used as required. The design just disclosed enables a filler material 53 to be used within the opening of the flange member. This filler material may be, for instance, wood, board, any compound, or thermal lagging. This embodiment may also be provided with tooth portions 54,55, for attaching a cladding sheet, for instance. In other respects the attachment may be accomplished by nailing, staples, screws, rivets, welding, etc.

Figure 6:
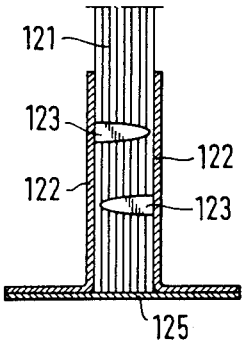
FIG. 6 is a sectional illustration of a compound beam structure according to an embodiment of the invention in which the flange member includes multiple parts.

FIG. 6 further depicts a compound beam structure 120 according to another advantageous embodiment of the invention. It differs from the preceding embodiments in that substantially U-shaped flange member attached to a web plate 121 consists of not less than three separate parts: two leg portions 122 and a separate, continuous, or interrupted, flange metal sheet 125 connecting the leg portions. A tooth portion 123, transversely extending from each leg portion fixededly attached the leg portion for the web plate 121.

The web plate 121 may consist of the same material (plywood, for instance) as in the example of FIG. 1. It is possible, for the purpose of binding the leg portions 122 and taking up the loads, to connect the leg portions to a continuous flange sheet 125 by welding, pressing or by a process resembling claw type pincers, with suitable spacing in each particular case, or continuously. The tooth portions 123 may be of any of the above-described types.

Several additional advantages are gained by a design of this kind.

The metal sheet strips to be mounted on either side of the edges of the simple web plates provided with teeth are easy to manufacture, to handle and to affix.

It is possible to manufacture parts of beams provided with leg portions alone to kept in storage.

It is possible to use metal, for example, steel in varying quantities and various flange configurations at different points of one structural part even if one and the same toothed fixing strip should be used throughout the production.

It is easy to use even low steel quantities. The continuous flange sheet may be replaced with transversel ties affixed at points where they are required.

The metal from which the covering sheet is made may differ essentially from the material from which the leg portions are made. It is also easier to use fibre reinforcements in the covering sheet.

The use of various, complex flange shapes is easy because the attachment to the web has been standardized.

The flange sheet need not have uniform thickness. It may have thinner edges in view of the attachment of the embodiment of FIG. 6. It is also conceivable that its thickness varies longitudinally, in accordance with the loads.

Depending on the material of the web, different types of leg portions strip may be used, for example, the shape, spacing of the tooth portions, the leg portion width, etc., may vary.

The stress needed in the structural part may be achieved by prestressing the leg portion to be mounted abutting against the web surface/or the flange sheet or both before attachment.

Figure 7:
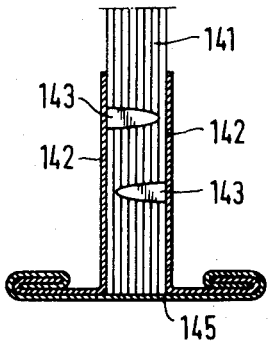
FIG. 7 is a sectional illustration of still another embodiment of the invention, similar to that of FIG. 6, in which overlapping joints are formed between the multiple parts of the flange.

FIG. 7 illustrates a compound beam structure 140 in which flange leg portions 142 and an end portion 145 are mutually joined by a so-called roofing joint. The affixing of the let portion to the end portion 145 may be carried out at a point adjacent to the web 141, by joining two layers of sheets, or at the thickest point of the flange 145, where the number layers of metal sheets is five.

Figure 8:
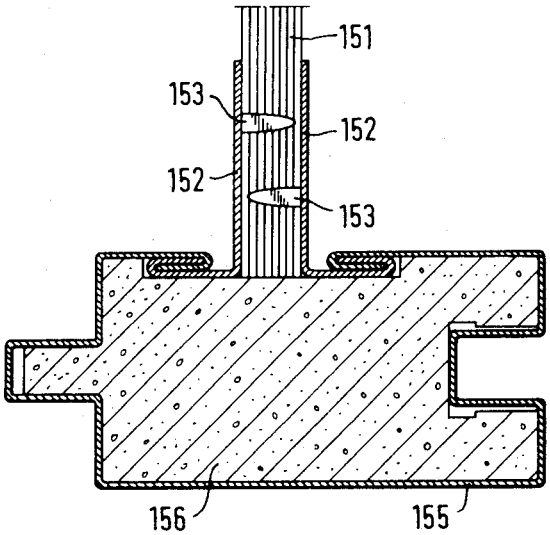
FIG. 8 is a sectional illustration of another embodiment of the invention.

FIG. 8 shows a compound beam structure 150 according to a special embodiment of the invention which makes possible the joining together of several beams or elements made of beams. The compound beam structure 150 has a substantially U-shaped flange member including leg portions 152 abutting against a part of the side surfaces of a web member 151 which include integral transversely extending tooth portions 153 which penetrate into the web member 151. An end portion 155 of the flange member, connecting the leg portions 152, is formed in the shape of a box-like structure having a chamber in which a filler substance 156 is placed. It is equally possible to affix other structural parts to the filler substance 156, which is a wood material, e.g. by nailing.

Figure 9:
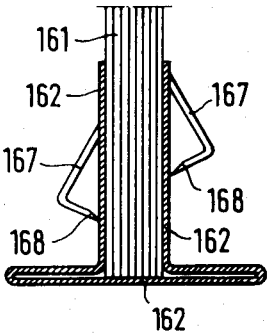
FIG. 9 is a sectional illustration of still another embodiment of a compound beam according to the invention in a preliminary stage in which the tooth portions have not penetrated into the web member.

FIG. 9 illustrates a compound beam structure 160 having a web plate 161 flange member 162 made from a single metallic sheet and which presents no problems of manufacturing technique because the tooth portions 167 have, prior to the pressing step, been bent out from the flange sheet 162 in hook fashion, with the tooth point 168 in the plane of the flange sheet for penetrating the web plate 161.

The modes of mechanical joining presented above are adequate in normal conditions, but they are not alone the best possible ways, because occasionally absolutely complete non-slip property of the joint is required. It is also a fact that the deformations due to moisture variations and the indeterminate forces thereby created may weaken the mechanical joint. If, again, the number of tooth portions bent out from the leg portions is very high, then the pressing of these teeth into the web may damage the web member. Even if the web should not be damaged, the joint area between flange and web may remain inadequate and the joint too weak if a mechanical joint is exclusively used. The joining area of the tooth portion punched out of the web plate is not necessarily optimum either.

Such a completely slip-free joint is achieved by using, in addition, an adhesive, for example, having a polyurethane, neoprene, phenol or resin base, between the surfaces of the web and the flange. The rate of curing of the glue may, as required, be regulated either by preheating the flange or by operating the flange as an electrical resistance. If the glue curing is not necessarily a job that can be done in the manufacturing facilities, it is possible immediately after the flange member has been pressed fast, to transport the product into storage, where the ultimate curing takes place, while the teeth maintain the requisite pressure.

When the metallic flange is affixed to the web plate by hollow or solid connectors, one gains larger joint surface areas in the fixing between flange and web than by means of the teeth punched out of the flange. Separate connectors, to be affixed during the manufacturing process, eliminate the handling problems which may arise when a complex-shaped and pre-toothed, for instance unipartite, flange sheet is being affixed to the surfaces of the web or is being otherwise handled. The strength and rigidity characteristics of the flange could be improved by taking a higher strength and more rigid type of sheet, for instance Fe 52,60 or 70. In such instances, however, difficulties arise owing to the failure tendency of the metals. This can be avoided by using various kinds of fibres (for instance, carbon fibres bonded to the flange sheets). The use of fibres bonded to the flange sheet increases the rigidity and strength of the metal sheet used for the flange, thereby improving the rigidity and strength of the structure. The fibre reinforcement are bonded onto the intact, unpunched and unperforated part of the flange, for instance in connection with the galvanizing process.

A remarkable additional advantage is gained with an embodiment example of the invention wherein the flanges have been prestressed prior to fastening the sheet to the web plate. If a certain normal stress—compression or tension—has been produced in only one of the two flanges prior to its pressing fast to the web plate, a stressed beam is obtained which is well known to present improved characteristics under bending stress, compared with a beam that has been made without stress. It is possible with the aid of stressed caused in the flanges prior to their fast-pressing, to prevent buckling of the web.

The sheet used for the flange may have a profiling, which lends greater rigidity to the flange, facilitates its handling and increases the surface area of the statically active metal sheet used for the flange.

While specific embodiments of the invention have been shown and described in detail to illustrate the application of the principles of the invention, it will be understood that the invention may be embodied otherwise without departing from such principles.

We claim:

1. A compound beam comprising an elongated non-metallic web member having oppositely disposed side surfaces and an end surface, a substantially U-shaped metallic flange member having leg portions abutting against a part of said oppositely disposed side surfaces of said web member and an end portion connecting said leg portions abutting against said end surface of said web member, each of said leg portions having a tooth portion formed as an integral part thereof extending transversely of said leg portions and penetrating through a substantial portion of the thickness of said web member toward the oppositely disposed leg portion to fixedly attach said flange member and said web member, each tooth portion having a length dimension greater than the distance between the opposite side surfaces of said web member and each of said tooth portions having a tip clinched back toward the respective leg portion to which it is attached.

2. A compound beam according to claim 1, wherein each of said tooth portions is dimensioned to traverse the thickness of said web member and contacts said leg portion of said flange member adjoining the opposite side surface of said web member.

3. A compound beam according to claim 1, wherein each of said tooth portions is dimensioned to traverse the thickness of said web member and is fixedly secured to said leg portion of said flange member adjoining the opposite side surface of said web member.

4. A compound beam according to claim 3, wherein each of said tooth portions includes an arcuate shaped portion.

5. A compound beam according to claim 4, wherein said non-metallic web member comprises plywood.

6. A compound beam according to claim 1, wherein each of said tooth portions has an arcuate shaped tip portion extending generally opposite to said arcuate tip portion of said other tooth portion of said opposite leg portion.

* * * * *